US012378749B2

(12) United States Patent
Xu et al.

(10) Patent No.: US 12,378,749 B2
(45) **Date of Patent: *Aug. 5, 2025**

(54) ENVIRONMENTALLY-FRIENDLY SEMI-CLOSED LOOP DEEP-SEA ORE HYDRAULIC LIFTING SYSTEM

(71) Applicants: CHINA MERCHANTS DEEPSEA RESEARCH INSTITUTE (SANYA) CO., LTD., Yazhou Sanya (CN); CHINA MERCHANTS MARINE AND OFFSHORE RESEARCH INSTITUTE CO., LTD., Shenzhen (CN)

(72) Inventors: Lixin Xu, Shenzhen (CN); Xiuzhan Zhang, Shenzhen (CN); Hejing Liu, Shenzhen (CN); Jiancheng Liu, Shenzhen (CN)

(73) Assignees: China Merchants Marine Offshore Research Institute Co.; China Merchants Deepsea Research Institute (Sanya) Co., Shenzhen (CN)

( * ) Notice: Subject to any disclaimer, the term of this patent is extended or adjusted under 35 U.S.C. 154(b) by 644 days.

This patent is subject to a terminal disclaimer.

(21) Appl. No.: 17/613,505

(22) PCT Filed: Dec. 25, 2020

(86) PCT No.: PCT/CN2020/139429

§ 371 (c)(1),
(2) Date: Nov. 23, 2021

(87) PCT Pub. No.: WO2021/143491

PCT Pub. Date: Jul. 22, 2021

(65) Prior Publication Data

US 2022/0259816 A1 Aug. 18, 2022

(30) Foreign Application Priority Data

Jan. 17, 2020 (CN) ..... 202010051551.6

(51) Int. Cl.
*E02F 7/00* (2006.01)
*E02F 3/88* (2006.01)
(Continued)

(52) U.S. Cl.
CPC ..... *E02F 3/8858* (2013.01); *E02F 3/94* (2013.01); *E02F 7/005* (2013.01); *E02F 7/10* (2013.01)

(58) Field of Classification Search
CPC . E02F 3/8858; E02F 3/94; E02F 7/005; E02F 7/10; E02F 7/065
See application file for complete search history.

(56) References Cited

U.S. PATENT DOCUMENTS 9,062,434 B2 * 6/2015 Espinasse ..... E02F 3/902
2014/0041262 A1 2/2014 Espinasse et al.
(Continued)

FOREIGN PATENT DOCUMENTS

CN 1344844 A 4/2002
CN 1125215 C 10/2003
(Continued)

*Primary Examiner* — Thomas B Will
*Assistant Examiner* — Robert E Pezzuto
(74) *Attorney, Agent, or Firm* — Proi Intellectual Property US

(57) ABSTRACT

An environmentally-friendly semi-closed loop deep-sea ore hydraulic lifting system, comprises a water injection pump, a water injection riser, a deep-sea multiple high-pressure silo feeding device, a lifting riser, a dewatering device and a pipeline. The water injection pump and the dewatering device are fixed on a mining ship. The water injection pump is connected to the deep-sea multiple high-pressure silo feeding device through the water injection riser. The deep-sea multiple high-pressure silo feeding device is connected to the dewatering device through the lifting riser. The water injection pump is connected to the dewatering device through the pipeline. Seawater is pumped into the water
(Continued)

injection riser by the water injection pump, then ore is fed into a high-pressure hydraulic pipeline by the deep-sea multiple high-pressure silo feeding device to be mixed with the seawater, and an obtained ore and seawater mixture is lifted to the mining ship on the sea surface.

5 Claims, 2 Drawing Sheets

(51) Int. Cl.

| | |
|---|---|
| ***E02F 3/90*** | (2006.01) |
| ***E02F 3/94*** | (2006.01) |
| ***E02F 7/06*** | (2006.01) |
| ***E02F 7/10*** | (2006.01) |

(56) References Cited

U.S. PATENT DOCUMENTS

| | | | | |
|---|---|---|---|---|
| 2017/0254044 | A1* | 9/2017 | Nguyen | F04B 47/06 |
| 2021/0293255 | A1* | 9/2021 | Van Rijswick | F04F 1/06 |

FOREIGN PATENT DOCUMENTS

| | | | |
|---|---|---|---|
| CN | 2729158 | Y | 9/2005 |
| CN | 109611097 | A | 4/2019 |
| CN | 110259453 | A | 9/2019 |
| CN | 111119897 | A | 5/2020 |
| CN | 211666714 | U | 10/2020 |
| JP | 2003269070 | A | 9/2003 |
| JP | 6557762 | B1 | 8/2019 |

* cited by examiner

ENVIRONMENTALLY-FRIENDLY SEMI-CLOSED LOOP DEEP-SEA ORE HYDRAULIC LIFTING SYSTEM

TECHNICAL FIELD

The present invention relates to the technical field of deep-sea mining, in particular to an environmentally-friendly semi-closed loop deep-sea ore hydraulic lifting system.

BACKGROUND ART

The seabed is rich in high-grade mineral resources, but they are generally located in deep sea and ultra-deep sea areas. Ore hydraulic lifting systems for deep-sea mining are the core technology of deep-sea mining. Deep-sea multi-stage lifting pumps are usually used to achieve high pumping head so as to meet the needs of deep-sea mining and to lift the ore-seawater slurry to mining ships. The multi-stage lifting pumps and their control systems are relatively complicated in design and are technically difficult, with many moving parts and low overall system reliability. When in use, the high-speed flow of the ore-seawater slurry will seriously wear the lifting pumps and affect the service life of the pumps. However, deep-sea lifting pumps are generally installed on the seabed or are suspended on risers so that they are difficult to repair and replace after wear, and the cost is relatively high. Moreover, in the process of ore lifting, deep-sea ore lifting pumps continuously pump seawater from the seabed, which will also affect the ecological environment of the seabed.

SUMMARY OF THE INVENTION

In order to solve the above-mentioned drawbacks, an object of the present invention is to provide an environmentally-friendly semi-closed loop deep-sea ore hydraulic lifting system with a more environmentally friendly working process, higher efficiency and higher reliability.

In order to realize the aforementioned object, the present invention discloses an environmentally-friendly semi-closed loop deep-sea ore hydraulic lifting system, which comprises a water injection pump, a water injection riser, a deep-sea multiple high-pressure silo feeding device, a lifting riser, a dewatering device and a pipeline. The water injection pump and the dewatering device are fixed on a mining ship. The water injection pump is connected to the deep-sea multiple high-pressure silo feeding device through the water injection riser. The deep-sea multiple high-pressure silo feeding device is connected to the dewatering device through the lifting riser. The water injection pump is connected to the dewatering device through the pipeline.

The water injection riser and the lifting riser may be rigid pipes, flexible pipes, or hybrid risers consisting of rigid pipes and flexible pipes.

The deep-sea multiple high-pressure silo feeding device comprises a storage silo, a high-pressure silo and a feeding silo connected in order from top to bottom, the number of the high-pressure silo is two or more, the outlet of the feeding silo is connected to a high-pressure pipeline, one end of the high-pressure pipeline is connected to the water injection riser, and the other end of the high-pressure pipeline is connected to the lifting riser.

A filling valve is provided between the storage silo and the high-pressure silo, and a discharge valve is provided between the high-pressure silo and the feeding silo.

The high-pressure silo is connected to the high-pressure pipeline through a pressurized pipeline, and the pressurized pipeline is equipped with a booster valve.

A pressure relief valve is provided on the high-pressure silo.

A feeding device is provided between the feeding silo and the high-pressure pipeline.

The feeding device is a screw feeder or an impeller feeder.

The beneficial effects of the present invention are as follows: the water injection pump on the mining ship is used to pump seawater into the water injection riser according to the pressure and flow rate required by the ore hydraulic lifting system, then ore is fed into a high-pressure hydraulic pipeline by the deep-sea multiple high-pressure silo feeding device to be mixed with the seawater, and then an obtained ore and seawater mixture is lifted to the mining ship on the sea surface. The dewatering device on the mining ship is used to separate the seawater from minerals. The water injection pump on the sea surface pumps the separated seawater into the water injection riser, thus forming a semi-closed loop circulation system. The present invention results in a very small amount of seawater exchange with the submarine environment so as to realize the minimum disturbance to the submarine ecological environment. The high-pressure silos of the deep-sea multiple high-pressure silo feeding device are redundant with each other, and work alternately under the cooperation of the control valve, thereby realizing uninterrupted feeding with high reliability and avoiding the use of deep-sea lifting pumps. In addition, sea surface water injection pumps are advantaged in high pumping head, large flow rate, easy maintenance and repair as well as low cost. It makes the hydraulic lifting system of the present invention more environmentally friendly and more efficient, with high pumping head, large flow rate and good reliability, and also makes it easy to maintain and repair.

Where: 1. water injection pump,
2. water injection riser,
3. deep-sea multiple high pressure silo feeding device,
4. lifting riser,
5. dewatering device,
6. pipeline,
7. mining ship,
8. seawater inlet connected by a high-pressure pipeline and a water injection riser,
9. ore-seawater slurry outlet connected by a high-pressure pipe and a lifting riser,
10. high-pressure pipeline,
11. storage silo,
12. high-pressure silo A,
13. high-pressure silo B,
14. feeding silo,
15. feeding device,
16. pressurized pipeline,
17. filling valve A,
18. discharge valve A,
19. filling valve B,
20. discharge valve B,

21. pressure relief valve A,
22. booster valve A,
23. pressure relief valve B,
24. booster valve B,
25. mixed ore seawater slurry.

DETAILED DESCRIPTION

The embodiments of the present invention are described in details in combination with the drawings.

Figure 1:
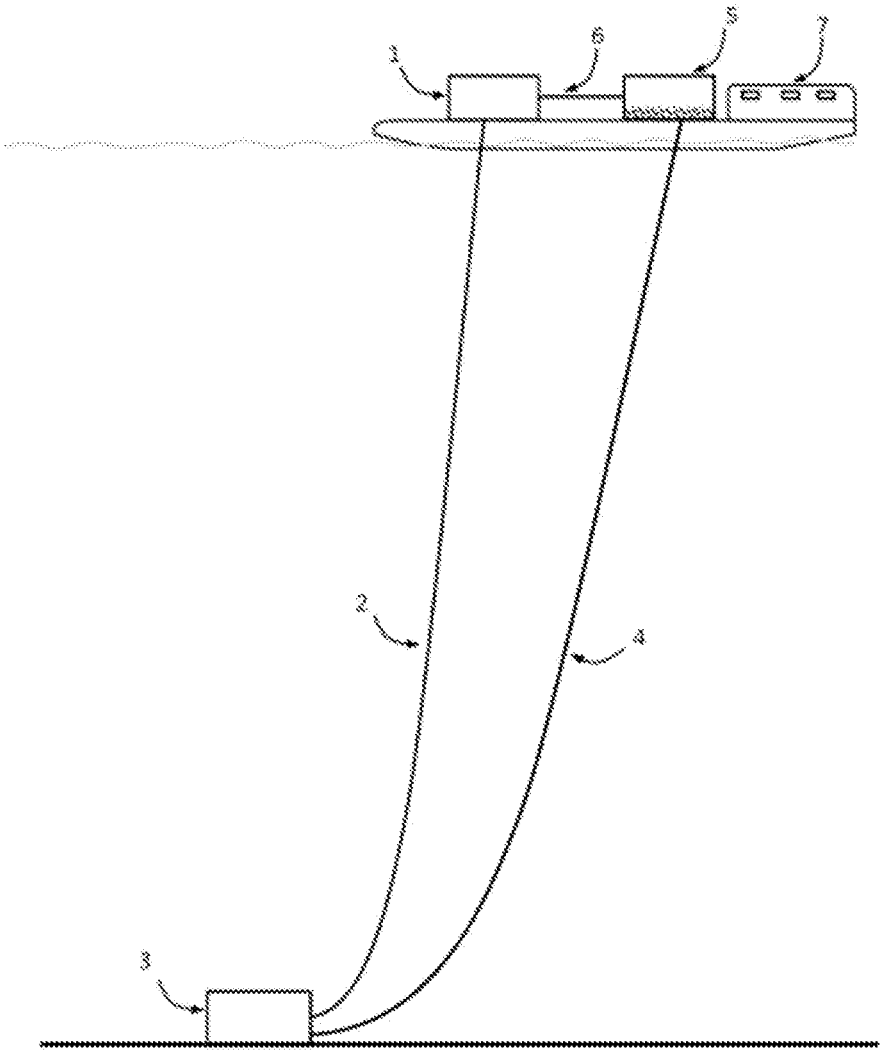
FIG. 1 is a schematic diagram of a structure of the present invention.

As shown in FIG. 1, an environmentally-friendly semi-closed loop deep-sea ore hydraulic lifting system, comprising a water injection pump 1, a water injection riser 2, a deep-sea multiple high-pressure silo feeding device 3, a lifting riser 4, a dewatering device 5 and a pipeline 6, wherein the water injection pump 1 and the dewatering device 5 are fixed on a mining ship 7, the water injection pump 1 is connected to the deep-sea multiple high-pressure silo feeding device 3 through the water injection riser 2, the deep-sea multiple high-pressure silo feeding device 3 is connected to the dewatering device 5 through the lifting riser 4, and the water injection pump 1 is connected to the dewatering device 5 through the pipeline 6. The water injection pump 1 pumps the required pressure and flow rate of seawater into the deep-sea ore hydraulic lifting system. A semi-closed loop circulation system is established through the water injection riser 2, the deep-sea multiple high-pressure silo feeding device 3, the lifting riser 4, the dewatering device 5 and the pipeline 6 so as to achieve the minimum disturbance to the submarine ecological environment. The water injection riser 2 and the lifting riser 4 may be rigid pipes, flexible pipes, or hybrid risers consisting of rigid pipes and flexible pipes.

Figure 2:
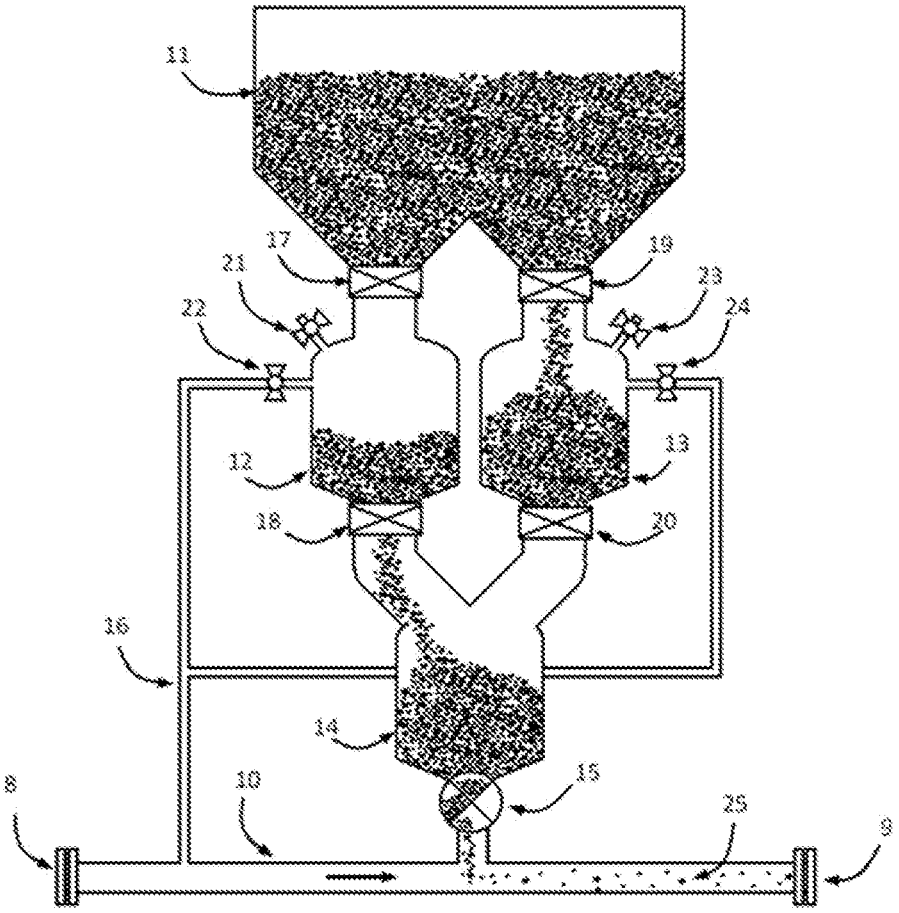
FIG. 2 is a schematic diagram of a structure of a deep-sea multiple high-pressure silo feeding device of the present invention (the schematic diagram shows a deep-sea dual high-pressure silo feeding device).

As shown in FIG. 2, the number of the deep-sea multiple high-pressure silo feeding device 3 of the present invention may be two or more. Multiple high-pressure silos are mutually redundant. In the case of failure of a high-pressure silo, the other high-pressure silos can still continue to work, thereby improving the reliability of the system. In this embodiment, a deep-sea dual high-pressure silo feeding device is used. It specifically comprises a storage silo 11, a dual high-pressure silo and a feed silo 14 connected in sequence from top to bottom. Wherein, the dual high-pressure silo comprises a high-pressure silo A12 and a high-pressure silo B13. The outlet of the feeding silo 14 is connected to a high-pressure pipeline 10, one end of the high-pressure pipeline 10 is connected to the water injection riser 2, and the other end of the high-pressure pipeline 10 is connected to the lifting riser 4. A filling valve A17 is provided between the storage silo 11 and the high-pressure silo A12, and a filling valve B19 is provided between the storage silo 11 and the high-pressure silo B13. A discharge valve A18 is provided between the high-pressure silo A12 and the feeding silo 14, and a discharge valve B20 is provided between the high-pressure silo B13 and the feeding silo 14. The high-pressure silo A12 and the high-pressure silo B13 are respectively connected to the high-pressure pipeline 10 through a pressurized pipeline 16, and a booster valve A22 and a booster valve B24 are respectively provided on the pressurized pipeline 16. The high-pressure silo A12 and the high-pressure silo B13 are respectively provided with a pressure relief valve A21 and a pressure relief valve B23. A feeding device 15 is provided between the feeding silo 14 and the high-pressure pipeline 10. The feeding device 15 is a screw feeder or an impeller feeder. By adjusting the feeding speed of the feeding device 15, the concentration of ore in the slurry is adjusted in real time according to the demand, so that the risk of pipeline blockage is reduced.

Uninterrupted feeding is realized by controlling the various valves on the deep-sea multiple high-pressure silo feeding device 3. Ore is transported from the storage silo 11 through the high-pressure silo A12 and the high-pressure silo B13 to the feeding silo 14, and the feeding device 15 transfers the ore into the high-pressure pipeline 10 according to the designated amount to be mixed with seawater, so that the ore is lifted onto the mining ship 7 through the lifting riser 4.

The working principles of the present invention are as follows: the water injection pump 1 on the mining ship 7 is turned on to pump seawater into the water injection riser 2 according to the flow rate required by the ore hydraulic lifting system, and the seawater passes through the water injection riser 2, passes through the high-pressure pipeline 10 of the deep-sea multiple high-pressure silo feeding device 3, returns to the lifting riser 4, reaches the dewatering device 5 on the mining ship 7 and then returns to the water injection pump 1 through the pipeline 6 so as to form a seawater circulation system.

The working process of the present invention:

Before starting, the filling valve A17, the discharge valve A18, the pressure relief valve A21 and the booster valve A22 of the high-pressure silo A12, and the filling valve B19, the discharge valve B20, the pressure relief valve B23 and the booster valve B24 of the high-pressure silo B13 in the deep-sea multiple high-pressure silo feeding device 3 are in a closed state. Then, a mining truck transports the ore to the storage silo 11.

The water injection pump 1 on the mining ship 7 is turned on to pump seawater into the water injection riser 2 according to the flow rate required by the ore hydraulic lifting system, and the seawater passes through the water injection riser 2, passes through the high-pressure pipeline 10 of the deep-sea multiple high-pressure silo feeding device 3, returns to the lifting riser 4, reaches the dewatering device 5 on the mining ship 7 and then returns to the water injection pump 1 through the pipeline 6 so as to form a seawater circulation system.

Then, the pressure relief valve A21 of the high-pressure silo A12 is opened. After the internal and external pressures of the high-pressure silo A12 are balanced, the filling valve A17 is opened, and the ore in the storage silo 11 falls into the high-pressure silo A12 under the gravity. When the ore in the high-pressure silo A12 reaches the set position, the filling valve A17 and the pressure relief valve A21 are in sequence closed to complete the filling of the high-pressure silo A12.

The booster valve A22 is opened to make the high-pressure silo A12 and the high-pressure pipeline 10 realize pressure balance. Then the discharge valve A18 is opened, and the ore in the high-pressure silo A12 enters the feeding silo 14 under gravity.

The feeding device 15 sends the ore in the feeding silo 14 into the high-pressure pipeline 10 according to the set feeding speed to be mixed with the seawater, so as to form an ore-seawater slurry 25. The ore-seawater slurry 25 is lifted to the dewatering device 5 on the mining ship 7 through the lifting riser 4 under the action of the high-pressure water flow. The dewatering device 5 separates seawater and ore. The water injection pump pumps the separated seawater into the water injection riser, thus forming a semi-closed loop circulation system to realize the recycling of seawater.

After all the ore in the high-pressure silo A12 falls into the feeding silo 14, the discharge valve A21 and the booster valve A22 are closed in sequence to complete the discharge of the high-pressure silo A12.

While unloading of the high-pressure silo A12 is performed, the filling of the high-pressure silo B13 is carried out. The pressure relief valve B23 of the high-pressure silo B13 is opened. After the internal and external pressures of the high-pressure silo B13 are balanced, the filling valve B19 is opened, and the ore in the storage silo 11 falls into the high-pressure silo B12 under the gravity. When the height of the ore pile in the high-pressure silo B13 reaches the set position, the filling valve B19 and the pressure relief valve B23 are in sequence closed to complete the filling of the high-pressure silo B13.

After the unloading of the high-pressure silo A12 is completed, the unloading of the high-pressure silo B13 is performed. The booster valve B24 is opened to make the high-pressure silo B13 and the high-pressure pipeline 10 realize pressure balance. Then the discharge valve B20 is opened, and the ore in the high-pressure silo B13 enters the feeding silo 14 under gravity. After all the ore in the high-pressure silo B13 falls into the feeding silo 14, the discharge valve B20 and the booster valve B24 are closed in sequence to complete the discharge of the high-pressure silo B13.

In this cycle, the high-pressure silo A12 and the high-pressure silo B13 work alternately with the cooperation of valves to realize uninterrupted filling and unloading. Uninterrupted feeding is realized through the feeding device 15, and the ore is lifted onto the mining ship. In addition, the high-pressure silo A and the high-pressure silo B are mutually redundant. In the case of failure of one high-pressure silo, the other high-pressure silo can continue to work, thereby improving the reliability of the system.

In the same principle, for a system containing more than two high-pressure silos, multiple high-pressure silos can also work alternately with the cooperation of valves so as to realize uninterrupted filling and unloading. Multiple high-pressure silos provide greater redundancy for the system.

In the whole process, there will be a very small amount of seawater exchange with the surrounding environment only during pressure relief and filling, so as to realize the minimum disturbance to the submarine ecological environment.

In the present invention, the water injection pump on the mining ship is used to pump seawater into the water injection riser according to the pressure and flow rate required by the ore hydraulic lifting system, then ore is fed into a high-pressure hydraulic pipeline by the deep-sea multiple high-pressure silo feeding device to be mixed with the seawater, and then an obtained ore and seawater mixture is lifted to the mining ship on the sea surface. The dewatering device on the mining ship is used to separate the seawater from minerals. The water injection pump on the sea surface pumps the separated seawater into the water injection riser, thus forming a semi-closed loop circulation system. The present invention results in a very small amount of seawater exchange with the submarine environment so as to realize the minimum disturbance to the submarine ecological environment. The high-pressure silos of the deep-sea multiple high-pressure silo feeding device are redundant with each other, and work alternately under the cooperation of the control valve, thereby realizing uninterrupted feeding with high reliability and avoiding the use of deep-sea lifting pumps. In addition, sea surface water injection pumps are advantaged in high pumping head, large flow rate, easy maintenance and repair as well as low cost. It makes the hydraulic lifting system of the present invention more environmentally friendly and more efficient, with high pumping head, large flow rate and good reliability, and also makes it easy to maintain and repair.

The invention claimed is:

1. An environmentally-friendly semi-closed loop deep-sea ore hydraulic lifting system, comprising a water injection pump, a water injection riser, a deep-sea multiple high-pressure silo feeding device, a lifting riser, a dewatering device and a pipeline, wherein the water injection pump and the dewatering device are fixed on a mining ship, the water injection pump is connected to the deep-sea multiple high-pressure silo feeding device through the water injection riser, the deep-sea multiple high-pressure silo feeding device is connected to the dewatering device through the lifting riser, and the water injection pump is connected to the dewatering device through the pipeline;

wherein the deep-sea multiple high-pressure silo feeding device comprises a storage silo, a high-pressure silo and a feeding silo connected in order from top to bottom, the number of the high-pressure silo is two or more, the outlet of the feeding silo is connected to a high-pressure pipeline, one end of the high-pressure pipeline is connected to the water injection riser, and the other end of the high-pressure pipeline is connected to the lifting riser;

wherein the high-pressure silo is connected to the high-pressure pipeline respectively through a pressurized pipeline, and the pressurized pipeline is respectively equipped with a booster valve;

wherein a pressure relief valve is provided on the high-pressure silo.

2. The environmentally-friendly semi-closed loop deep-sea ore hydraulic lifting system according to claim 1, wherein the water injection riser and the lifting riser may be rigid pipes, flexible pipes, or hybrid risers consisting of rigid pipes and flexible pipes.

3. The environmentally-friendly semi-closed loop deep-sea ore hydraulic lifting system according to claim 1, wherein a filling valve is provided between the storage silo and the high-pressure silo, and a discharge valve is provided between the high-pressure silo and the feeding silo.

4. The environmentally-friendly semi-closed loop deep-sea ore hydraulic lifting system according to claim 1, wherein a feeding device is provided between the feeding silo and the high-pressure pipeline.

5. The environmentally-friendly semi-closed loop deep-sea ore hydraulic lifting system according to claim 4, wherein the feeding device is a screw feeder or an impeller feeder.

* * * * *